US010629174B1

(12) United States Patent
White

(10) Patent No.: US 10,629,174 B1
(45) Date of Patent: Apr. 21, 2020

(54) GUITAR SUPPORT PAD AND PLAYING METHOD

(71) Applicant: Carter B. White, Irvive, CA (US)

(72) Inventor: Carter B. White, Irvive, CA (US)

( * ) Notice: Subject to any disclaimer, the term of this patent is extended or adjusted under 35 U.S.C. 154(b) by 0 days.

(21) Appl. No.: 16/170,778

(22) Filed: Oct. 25, 2018

(51) Int. Cl.
*G10G 5/00* (2006.01)

(52) U.S. Cl.
CPC ..... *G10G 5/005* (2013.01)

(58) Field of Classification Search
CPC ..... G10G 5/005
See application file for complete search history.

(56) References Cited

U.S. PATENT DOCUMENTS 4,084,584 A * 4/1978 Detty ..... A61F 13/061 2/24
4,457,032 A * 7/1984 Clarke ..... B60N 2/60 297/219.1
9,495,945 B1 * 11/2016 George ..... G10G 5/005

* cited by examiner

*Primary Examiner* — Kimberly R Lockett
(74) *Attorney, Agent, or Firm* — Stetina, Brunda, Garred and Brucker

(57) ABSTRACT

A guitar support pad for placement on the thigh of a seated guitar player to resist movement of the guitar and digging of the guitar body into the thigh comprises essentially a thin, flexible rectangularly-shaped body of uniform thickness. The pad preferably has a soft, resilient upper part for supporting a guitar body and maintaining it in a fixed position, and a lower part consisting of a thin sheet which is flexible enough to drape conformally over a player's thigh, while resisting sliding movement of the pad on the thigh. A preferred embodiment of a guitar support pad according to the present invention includes a rectangular sheepskin having a wool upper part and a tanned lower hide part. A preferred method of using the pad includes draping the pad over the thigh, positioning a guitar on the wooly surface of the pad and strumming or picking the guitar strings.

20 Claims, 5 Drawing Sheets

GUITAR SUPPORT PAD AND PLAYING METHOD

BACKGROUND OF THE INVENTION

A. Field of the Invention

The present invention relates to musical instruments and methods for playing them. More particularly, the invention relates to a guitar support pad and method of using the pad to prevent a guitar from digging into or sliding down the leg of a seated guitar player.

B. Description of Background Art

Estimates of the number of guitar players in the United States and worldwide vary substantially, but reasonable estimates include about 40 million players in the United States alone, and at least 260 million worldwide. Professional musicians typically play guitars while standing. However, certain performances utilize seated guitar players. Probably a majority of amateur musicians typically play the guitar in a seated position.

Playing a guitar while seated is usually more comfortable for a musician than playing in a standing position. A seated guitar player typically rests the body of a guitar on an upper surface of the thigh region of a player's leg, strumming or picking the guitar strings with the hand located on the same side as the supporting thigh, and maintains the guitar in place by grasping the neck of the guitar with the opposite hand.

Although playing a guitar while seated is generally more comfortable and less fatiguing than playing in a standing position, there are certain problems associated with the seated position. Specifically, there may be a tendency for a guitar to dig into the supporting thigh, or to slide on the surface of the thigh or on an item of clothing, such as a trouser leg, that covers the leg. These problems may be aggravated by humid environments, which can make surfaces more slippery. The present invention was conceived of at least in part as a solution to such problems associated with playing a guitar in a seated position, by providing a novel guitar support pad and method for playing a guitar using the pad.

OBJECTS OF THE INVENTION

An object of the present invention is to provide a guitar support pad for increasing the positional stability of a guitar supported on a thigh of a seated musician's leg, and preventing the guitar from digging into the thigh.

Another object of the invention is to provide a lightweight guitar support pad which will not interfere with a guitar player's strumming or picking motions.

Another object of the invention is to provide a guitar support pad that has generally the shape of a thin, flat, pad which is sufficiently flexible to be conformable to the upper surface of a musician's thigh, the pad having a soft upper surface that is effective in supporting the body of a guitar and maintaining the guitar in a desired position.

Another object of the invention is to provide a guitar support pad that has an upper surface which is effective in supporting and maintaining the body of a guitar in a desired playing position on a musician's thigh, and a lower surface which provides a comfortable contact with a musician's thigh or an item of clothing overlying the thigh, while having sufficient frictional resistance to inhibit sliding movement of the pad relative to a musician's leg.

Another object of the invention is to proved a method of using a guitar support pad to facilitate playing a guitar by a seated musician.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications to the invention reasonably inferable from the description contained herein be included within the scope of the invention as defined by the appended claims.

SUMMARY OF THE INVENTION

Briefly stated, the present invention comprehends a guitar support pad for placement on the leg of a seated musician and supporting the body of a guitar, and a method of playing a guitar using the guitar support pad.

A guitar support pad according to the present invention includes a thin, flexible pad of an appropriate size and sufficient flexibility to enable draping the pad over the thigh of a seated musician. According to the invention, the guitar support pad has a soft upper surface which is effective in supporting the body of a guitar in a position desired by a musician, minimizing sliding motions of the guitar body from a desired position, and preventing the guitar from digging into the player's thigh The upper surface of the guitar support surface is preferably made of a soft, resilient material to minimize the possibility of marring surfaces of the guitar body.

According to the invention, the guitar support pad has a lower surface that is sufficiently flexible to enable the pad to be conformable to the curved upper surface of a seated musician's leg, and soft enough to comfortably contact the leg directly, or contact the surface of part of an item of clothing, such as a trouser leg.

The guitar support pad according to the present invention is made of a material which gives the lower surface of the pad a comfortable soft surface that has a sufficiently large coefficient of sliding friction relative to human skin and clothing fabrics to minimize any tendency for the guitar pad to slide or slip away from a desired position on a musician's leg.

A guitar support pad according to the present invention has a flexible, soft, resilient upper surface, and a flexible, soft lower surface that has a sufficiently high surface coefficient of sliding friction to minimize sliding movement of the guitar support pad from a desired position on a bare leg or an article of clothing covering the leg.

According to one embodiment of the present invention, a guitar support pad is provided which has a composite structure, including a flexible, relatively thick, soft, resilient upper layer or laminate, and a flexible, relatively thinner lower layer which may be somewhat harder than the upper laminate.

A preferred embodiment of guitar support pad according to the present invention is fabricated as a rectangular plan-view sheet of a tanned sheepskin having a width of about 11 inches and a depth of about 7 inches. An example embodiment of a guitar support pad according to the present invention was made from an 11 inch by 7 inch rectangular piece of tanned sheepskin. The lower, tanned leather part of the sheepskin had a thickness of about 1/16th inch, and the upper, wool part of the sheepskin had a thickness of about 1 inch.

A method of playing a guitar using the guitar support pad according to the present invention consists of the following steps. First, the guitar support pad is placed on the upper thigh part of a leg, e.g., the right leg, of a seated musician, with the long dimension of the pad perpendicular to the leg, and draped conformally over the leg. Next, the body of a guitar is set down by the musician at a desired location on the upper, wool surface of the guitar support pad. With the body of the guitar thus positioned, the upper end of the neck of the guitar is gripped by the hand on the opposite side of the musician's body, e.g., the left hand, that is also used to press strings of the guitar against frets in a conventional manner. The hand closest to the body of the guitar is then used to pick or strum the guitar strings in a conventional manner.

DESCRIPTION OF THE PREFERRED EMBODIMENTS

Figure 8:
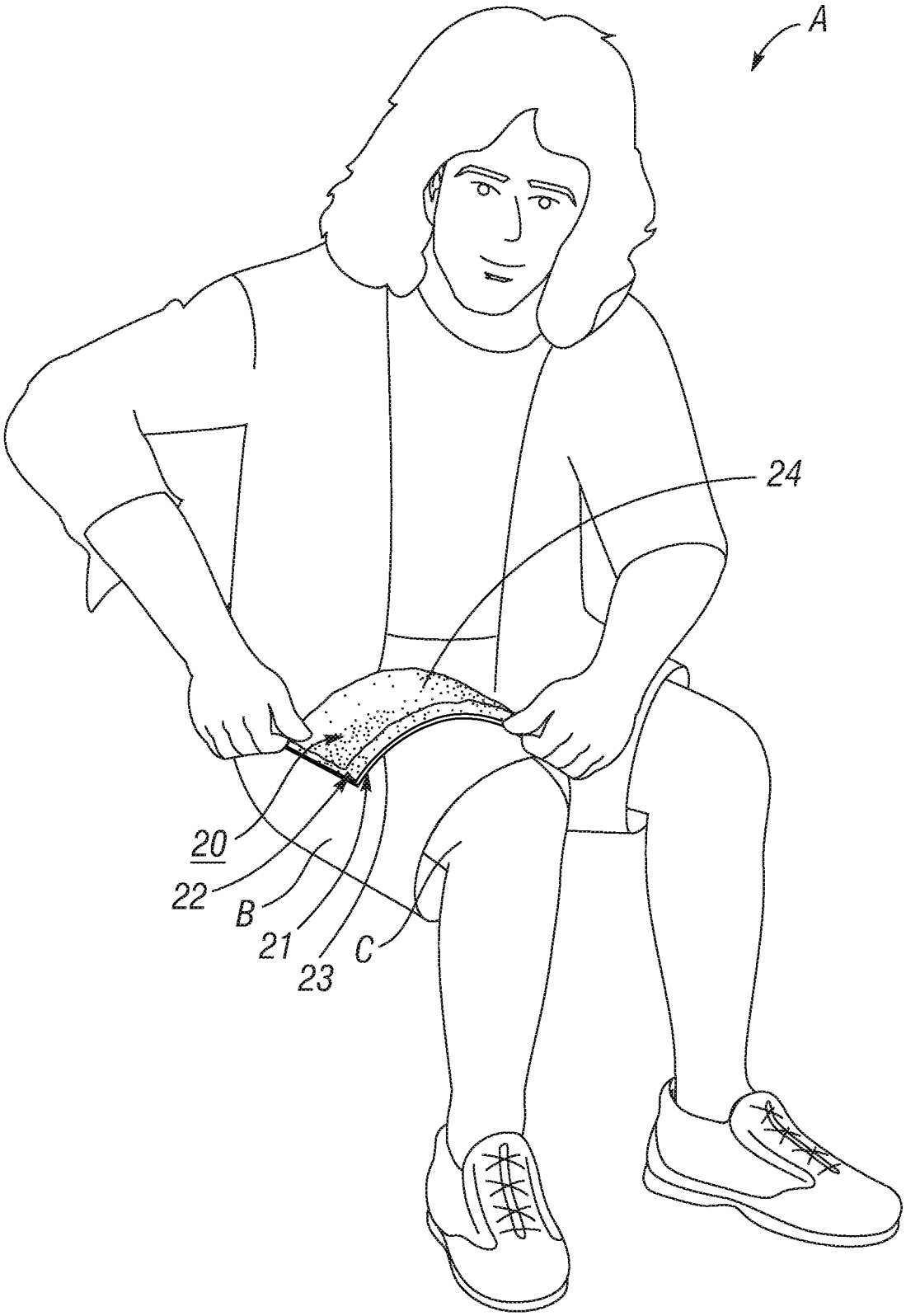
FIG. 8 is a perspective view showing the method of placing the guitar support pad of FIGS. 1-7 on the upper surface of the right thigh of a musician.
Figure 9:
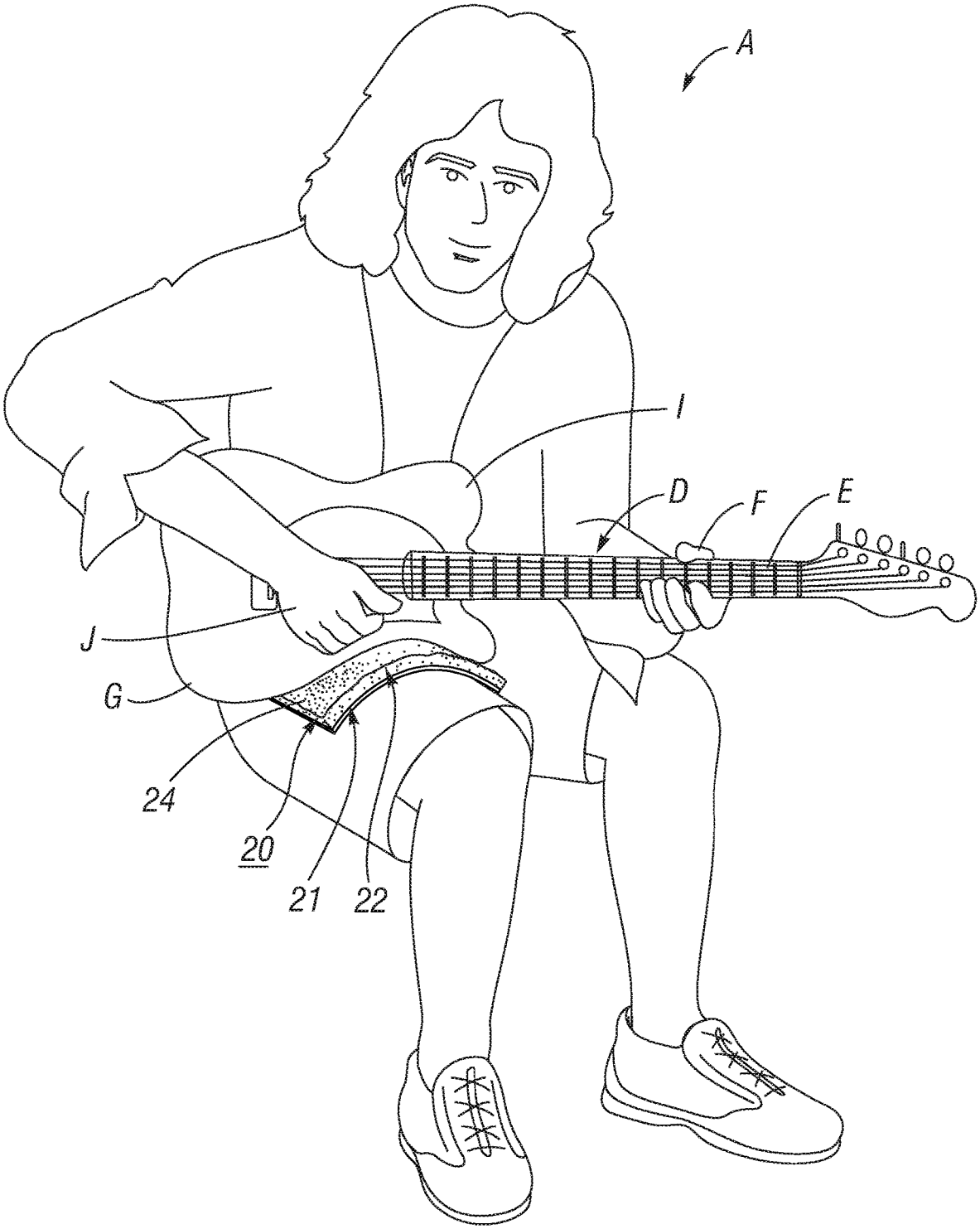
FIG. 9 is a perspective view showing the manner of using the support pad of FIGS. 1-8.

FIGS. 1-7 illustrate a preferred embodiment of a guitar support pad according to the present invention, and FIGS. 8-9 illustrate a method of playing a guitar according to the present invention.

Figure 1:
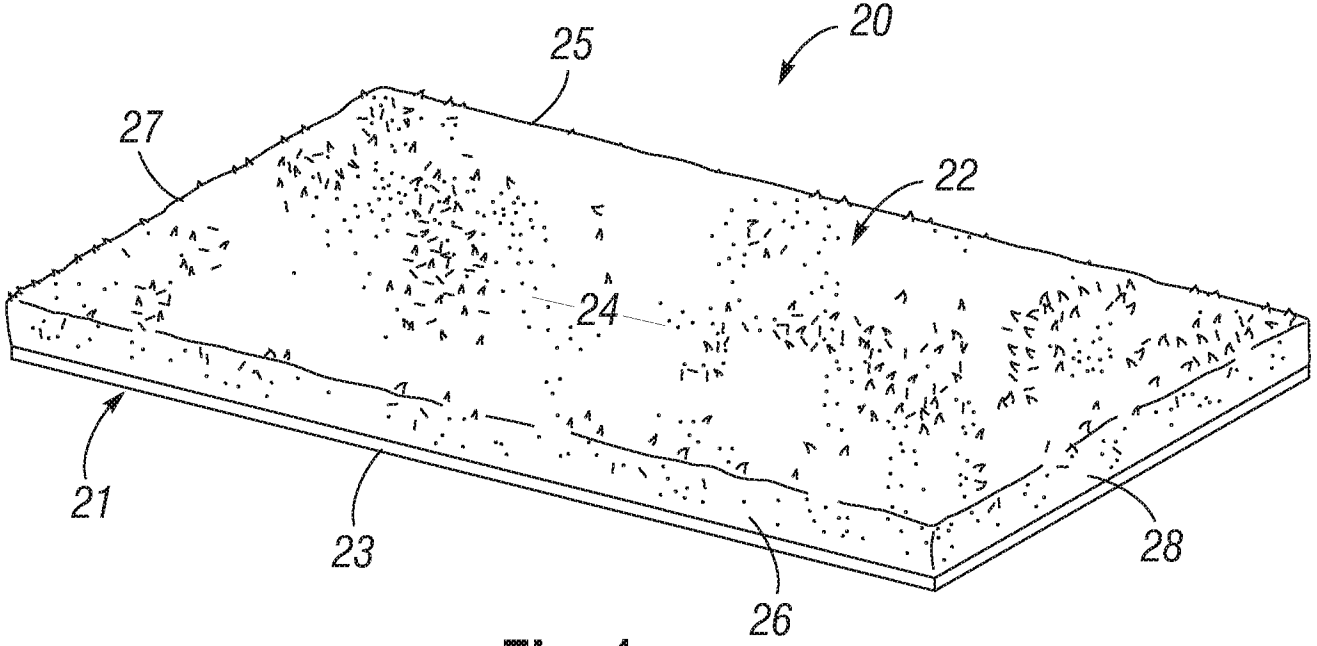
FIG. 1 is a perspective view of guitar support pad according to the present invention.

Referring first to FIGS. 1-7, it may be seen that a guitar pad 20 according to the present invention has generally the shape of a thin, rectangularly-shaped slab. As shown in FIG. 1, guitar support pad 20 preferably has a laterally elongated, rectangular plan view shape. Although the dimensions of pad 20 are not critical, the present inventor has determined that suitable dimensions for the pad include a width of about 11 inches and a depth of about 7 inches. And although a preferred embodiment of pad 20 shown in FIG. 1 has a rectangular plan-view outline, different outline shapes may also be used. Thus some or all of the four corners of the rectangular pad 20 could be rounded off into arcuately-curved shapes and still accomplish the objectives of the present invention.

As shown in FIG. 1, guitar support pad 20 has a heterogenous, composite structure that includes a thin, rectangularly-shaped base panel 21 and a thicker upper padding section 22. Preferably, both upper padding section 22 and base panel 21 are made of soft, flexible materials. As will be explained later, both upper padding section 22 and base panel 21 should be flexible so that guitar support pad 20 may be draped conformally over the thigh of a seated guitar player. Also, the outer, lower surface 23 of base panel 21 should have a sufficiently large coefficient of friction so that it does not have a tendency to slide too easily on the surface of a guitar player's thigh, or on clothing covering the thigh.

In addition to a requirement of flexibility, upper padding section 22 of guitar support pad 20 should provide a soft, resilient, non-slip support surface for the body of a guitar supported by the pad. Accordingly, upper surface 24 of upper padding section 22 preferably is made of a soft, resilient material that is capable of providing a suitable support surface for a guitar body.

Preferably, guitar support surface 24 of guitar support pad 20 has a reasonably good water absorption characteristics. That property would be desirable because it has been found that playing a guitar while seated in a warm, humid environment can result in an excessive amount of condensation moisture forming on the body of the guitar, increasing the tendency of the guitar to slide away from a desired location on the player's thigh.

The present inventor has discovered that a novel and highly effective composite support pad that has the desired characteristics identified above can be manufactured from a tanned sheepskin. An example embodiment of a guitar support pad 20 according to the present invention was fabricated from a sheepskin having a relatively thin leather hide part having a thickness of about 1/16th inch, and a relatively thicker outer wool part having a thickness of about 1 inch.

Figure 2:
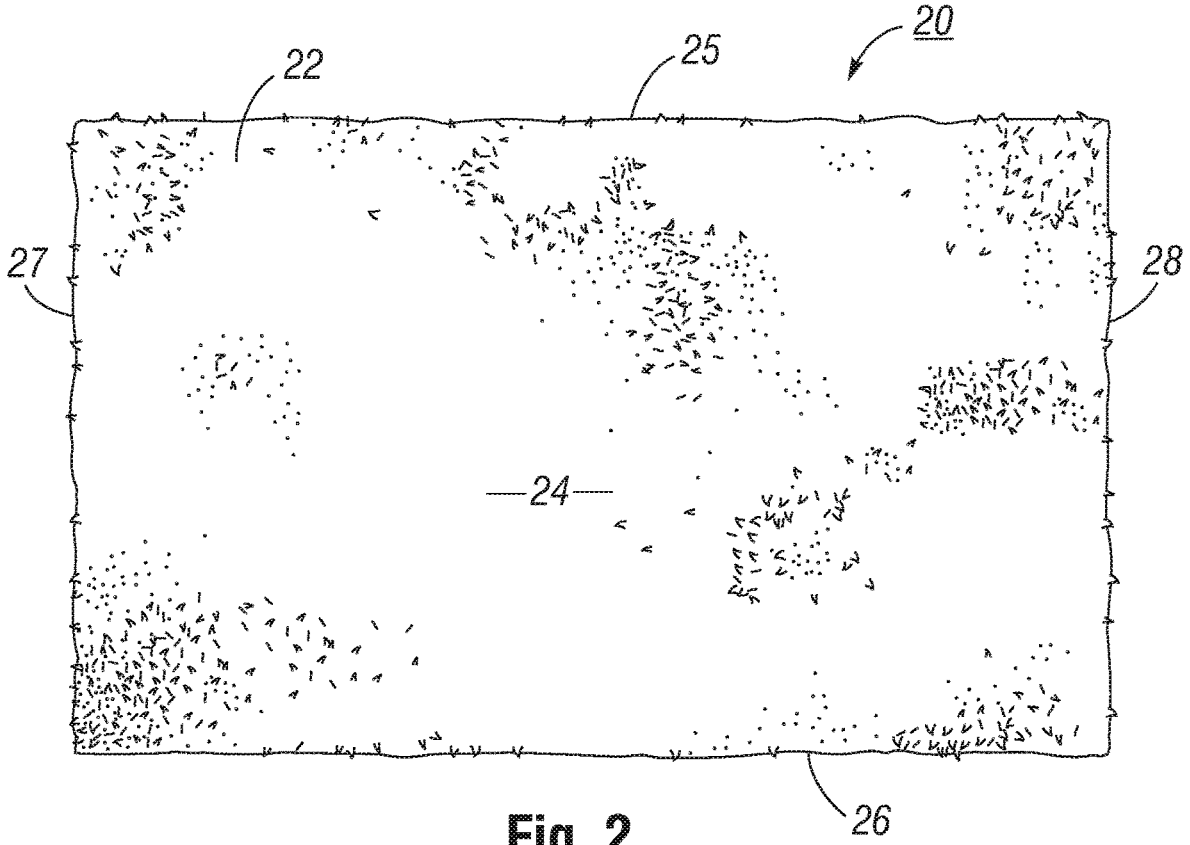
FIG. 2 is a top plan view thereof.
Figure 3:
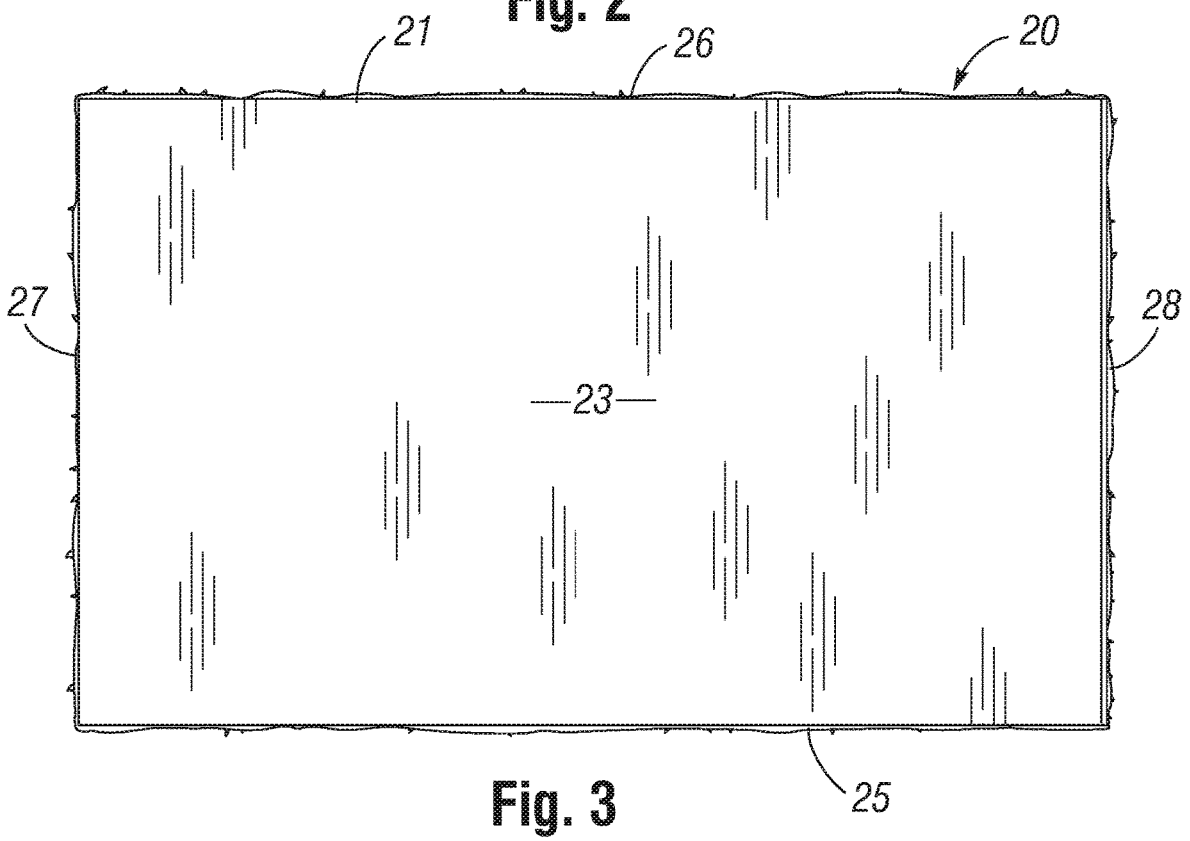
FIG. 3 is a bottom plan view thereof.
Figure 4:
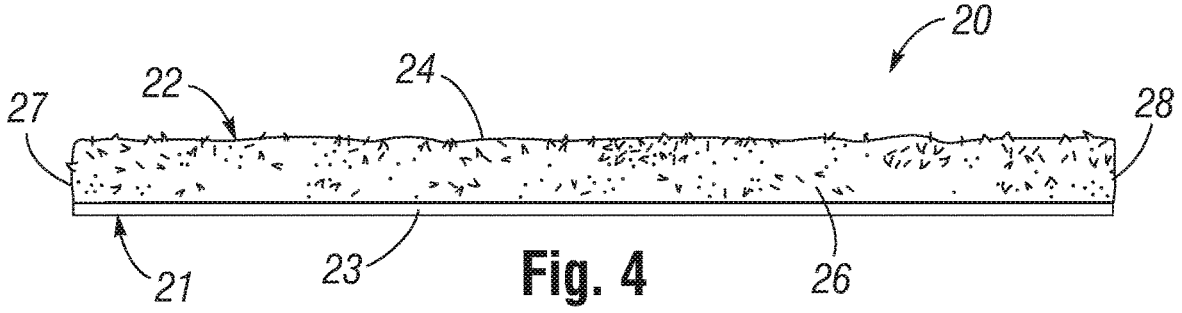
FIG. 4 is a front elevation view thereof.
Figure 5:
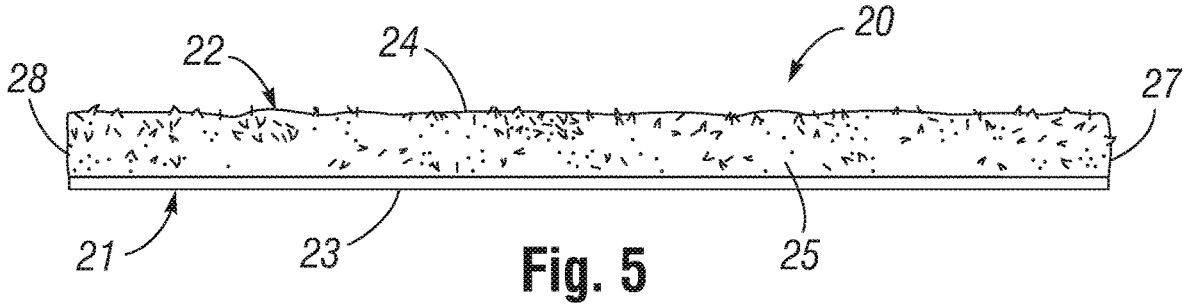
FIG. 5 is a rear elevation view thereof.
Figure 6:
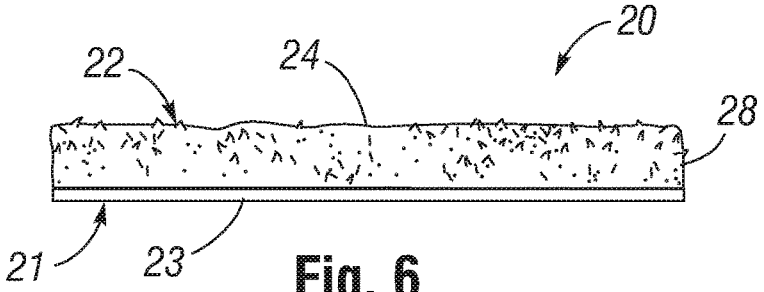
FIG. 6 is a right-side elevation view thereof.
Figure 7:
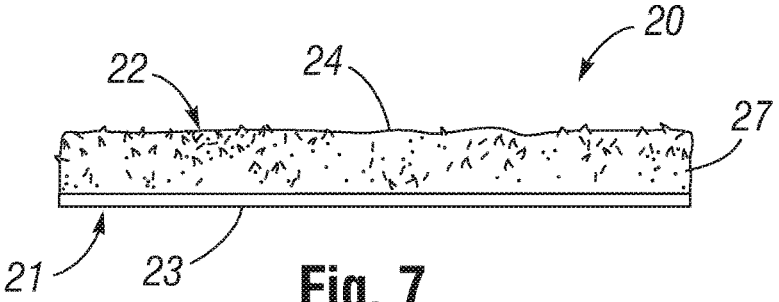
FIG. 7 is a left-side elevation view thereof.

As shown in FIGS. 1 and 2, an example embodiment of a guitar support pad 20 according to the present invention has a laterally-elongated, rectangular shape. The pad 20 has a straight rear side 25 having a length of about 11 inches, a straight front side 26 parallel to and having the same length as the rear side, a left side 27 perpendicular to the front and rear sides having a length of about 7 inches, and a right side 28 parallel to the left side and having the same length. The example embodiment of guitar support pad 20 had a total thickness of about 1 1/16 inches.

FIGS. 8 and 9 illustrate a method of playing a guitar using the guitar support pad 20 according to the present invention.

The following description applies to the use of guitar support pad 20 by a right-handed guitar player playing a right-handed guitar. It will be understood that guitar pad 20 is interchangeably usable by a left-handed guitar player playing a left-handed guitar.

Referring first to FIG. 8, a seated right-handed guitar player A is shown placing guitar support pad 20 on a right trouser leg B covering the player's right thigh C. Next, as shown in FIG. 9, guitar player A grasps the neck E of a guitar D in the player's left hand F, and places the outer, finger-side side wall G of the guitar body H on the upper surface 24 of guitar support pad 20.

As shown in FIG. 9, the arcuately-curved indentation I in outer, finger-side side wall G of guitar body H is conformally supported by the upper surface 24 of guitar support pad 20. The upper surface 24 of guitar support pad 20 is convexly curved as a result of pad 20 being draped conformally over the player's thigh. With this arrangement, guitar player A is enabled to play guitar D in a conventional fashion, pressing strings against frets with the left hand and strumming or picking lower parts of the strings with the right hand, with the guitar held securely in place on the player's thigh by the resilient, non-slip support provided by guitar support pad 20.

What is claimed is:

1. A guitar support pad comprising a sheet of flexible material including a peripheral edge and a middle region extending entirely and continuously within the peripheral edge, wherein said middle region has surface area dimensions substantially greater than the thickness of the sheet, an upper surface that is compressible, and a lower surface which is at least partially conformably drapable over the upper part of a seated musician's leg.

2. The guitar support pad of claim 1 wherein said upper surface has a fibrous texture.

3. The guitar support pad of claim 1 wherein said lower surface of said sheet has a coefficient of friction large enough to inhibit free sliding motion of said pad on a bare or clothed leg.

4. The guitar support pad of claim 1 wherein said sheet of material has a composite structure.

5. The guitar support pad of claim 4 wherein said sheet of material has a laminated structured.

6. The guitar support pad of claim 5 wherein said sheet of material includes an upper lamination made of a resiliently compressible material.

7. The guitar support pad of claim 6 wherein said sheet of material includes a lower lamination made of a material which has a coefficient of friction large enough to inhibit free sliding motion of said pad on a bare or clothed leg.

8. The guitar support pad of claim 5 wherein said sheet of material includes a lower lamination made of a material which has a coefficient of friction large enough to inhibit free sliding motion of said pad on a bare or clothed leg.

9. The guitar support pad of claim 8 wherein said sheet of material includes an upper lamination made of resiliently compressible material, both the upper lamination and the lower lamination extending continuously and entirely within the peripheral edge, the lower lamination being thinner than the upper lamination.

10. A method of using a guitar support pad to facilitate playing a guitar, said method comprising the steps of:

a. draping a guitar support pad conformably over the leg of a seated guitar player, said guitar support pad including opposing upper and lower surfaces, a peripheral edge and a middle region extending entirely and continuously within the peripheral edge, the guitar support pad being draped with said lower surface of said pad facing the player's leg, b. positioning the body of a guitar at a desired position on said upper surface of said guitar support pad, c. grasping the neck of the guitar in the hand of the player opposite the leg on which the guitar support pad has been draped, d. strumming or picking lower parts of strings of the guitar with the player's hand adjacent to the player's leg where said guitar is supported, and e. pressing the upper ends of the guitar strings against frets.

11. A guitar support pad for use by a seated guitar player comprising essentially of a tanned sheepskin, said tanned sheepskin including a peripheral edge and a middle region extending entirely and continuously within the peripheral edge and having generally a size and shape which enable said sheepskin to be draped over the upper leg of a seated guitar player, said sheepskin having a wooly upper section for supporting a guitar body and a tanned leather lower section for placement on a bare or clothed leg of a seated guitar player.

12. The guitar support pad of claim 11 wherein said upper woolly section of said sheepskin has a thickness in the approximate range of about ¾ inch to about 1½ inch.

13. The guitar support pad of claim 12 wherein said sheepskin has a lower leather section that has a thickness in the approximate range of about $1/16^{th}$ inch to about ⅛ inch.

14. The guitar support pad of claim 11 wherein said lower leather section has a thickness in the approximate range of about $1/16^{th}$ inch to about ⅛ inch.

15. The guitar support pad of claim 14 wherein said upper wooly section of said sheepskin has a thickness in the approximate range of about ¾ inch to about 1½ inch.

16. The guitar support pad of claim 11 wherein said sheepskin has a larger surface area dimension of about 11 inches.

17. The guitar support pad of claim 16 wherein said sheepskin has a smaller surface area dimension of about 7 inches.

18. The guitar support pad of claim 17 wherein said sheepskin has a rectangular shape.

19. The guitar support pad of claim 17 wherein said sheepskin has a curvilinear shape.

20. A method of player a guitar comprising the steps a. draping a sheepskin over the upper leg of a seated guitar player, the sheepskin having a peripheral edge, a middle region extending entirely and continuously within the peripheral edge, a wool upper surface and a tanned leather lower surface, the sheepskin being draped over the seated guitar player with the tanned lower surface facing the leg, b. positioning the body of a guitar on the upper woolly surface of the sheepskin at a desired location, c. grasping the neck of the guitar in the hand of the player opposite the leg on which the guitar support pad has been draped, d. strumming or picking lower parts of strings of the guitar with the player's had adjacent to the player's leg where said guitar is supported, and e. pressing the upper ends of the guitar strings against frets.

* * * * *